US008919761B2

(12) United States Patent
Morinaga et al.

(10) Patent No.: US 8,919,761 B2
(45) Date of Patent: Dec. 30, 2014

(54) SHEET CONVEYING DEVICE

(75) Inventors: Kazuyuki Morinaga, Machida (JP); Kuniaki Sato, Inagi (JP)

(73) Assignee: Canon Kabushiki Kaisha, Tokyo (JP)

( * ) Notice: Subject to any disclaimer, the term of this patent is extended or adjusted under 35 U.S.C. 154(b) by 95 days.

(21) Appl. No.: 13/327,968

(22) Filed: Dec. 16, 2011

(65) Prior Publication Data

US 2012/0161382 A1 Jun. 28, 2012

(30) Foreign Application Priority Data

Dec. 28, 2010 (JP) ..... 2010-293809

(51) Int. Cl.

| | |
|---|---|
| ***B65H 5/00*** | (2006.01) |
| ***B65H 3/06*** | (2006.01) |
| ***B65H 5/06*** | (2006.01) |
| ***B65H 7/02*** | (2006.01) |

(52) U.S. Cl.

CPC ..... *B65H 3/0684* (2013.01); *B65H 3/0669* (2013.01); *B65H 5/062* (2013.01); *B65H 7/02* (2013.01); *B65H 2403/422* (2013.01); *B65H 2403/481* (2013.01); *B65H 2403/721* (2013.01); *B65H 2405/3321* (2013.01); *B65H 2511/20* (2013.01); *B65H 2511/514* (2013.01); *B65H 2513/41* (2013.01); *B65H 2513/512* (2013.01); *B65H 2513/514* (2013.01); *B65H 2701/1311* (2013.01); *B65H 2701/1313* (2013.01); *B65H 2801/06* (2013.01); *B65H 2801/39* (2013.01)

USPC ..... 271/10.13; 271/4.04; 271/10.04; 271/273; 271/186

(58) Field of Classification Search

USPC ..... 271/4.04, 10.04, 10.13, 273, 186

See application file for complete search history.

(56) References Cited

U.S. PATENT DOCUMENTS

| | | | | |
|---|---|---|---|---|
| 5,091,754 | A | 2/1992 | Abe et al. | |
| 5,154,411 | A | 10/1992 | Saito et al. | |
| 5,172,138 | A | 12/1992 | Okazawa et al. | |
| 5,398,108 | A | 3/1995 | Morinaga et al. | |
| 5,571,265 | A | 11/1996 | Yagi et al. | |
| 5,713,060 | A | 1/1998 | Sato et al. | |
| 5,722,654 | A | 3/1998 | Sootome et al. | |
| 6,113,093 | A | 9/2000 | Morinaga et al. | |
| 6,206,368 | B1 * | 3/2001 | Kobayashi et al. | 271/273 |
| 6,446,954 | B1 * | 9/2002 | Lim et al. | 271/10.04 |
| 6,522,860 | B2 * | 2/2003 | Nose et al. | 399/374 |
| 6,581,922 | B2 | 6/2003 | Kuwata et al. | |
| 7,367,556 | B2 * | 5/2008 | Lin et al. | 271/118 |

(Continued)

FOREIGN PATENT DOCUMENTS

| | | |
|---|---|---|
| JP | 2007-230657 | 9/2007 |

*Primary Examiner* — Prasad Gokhale

(74) *Attorney, Agent, or Firm* — Fitzpatrick, Cella, Harper & Scinto

(57) ABSTRACT

The present invention provides a sheet conveying device comprising a first conveyance path for conveying a sheet from a pair of first rollers to a pair of second rollers, a second conveyance path for performing switchback conveyance of the sheet, a switching unit for switching the second rollers between a press-contacted state and a separated state, and a single driving source for driving the rollers and the switching unit. A non transferring of drive section is set where when the driving source switches the rotation direction after the sheet that has been switchback-conveyed has reached the first rollers, a drive from the driving source is not transferred to the second rollers. The switching unit is driven to separate the second rollers during a time the drive is not transferred to the second rollers due to the non transferring of drive section.

13 Claims, 13 Drawing Sheets

(56) References Cited

U.S. PATENT DOCUMENTS

| | | | | |
|---|---|---|---|---|
| 7,530,568 | B2 * | 5/2009 | Uchida et al. | 271/273 |
| 7,832,724 | B2 * | 11/2010 | Lo et al. | 271/186 |
| 7,934,717 | B2 * | 5/2011 | Takeda et al. | 271/4.04 |
| 8,505,909 | B2 * | 8/2013 | Hagiyama | 271/186 |
| 2009/0224466 | A1 * | 9/2009 | Mitamura | 271/273 |
| 2011/0115146 | A1 * | 5/2011 | Shimomura et al. | 271/10.13 |
| 2011/0133397 | A1 | 6/2011 | Shimmachi et al. | |
| 2011/0140353 | A1 | 6/2011 | Morinaga et al. | |
| 2012/0161383 | A1 * | 6/2012 | Sato et al. | 271/10.13 |

* cited by examiner

FIG. 13

| STEP | SHEET | SENSOR 53 | MOTOR 17 | FEEDING PLANET GEAR 43a | FEED ROLLER | CONVEYANCE ROLLER | DISCHARGE CAM GEAR | DISCHARGE ROLLER | DISCHARGE IDLER ROLLER |
|---|---|---|---|---|---|---|---|---|---|
| S1 | START OF FEEDING | | FORWARD ROTATION | FEEDING POSITION | FORWARD ROTATION | FORWARD ROTATION | DRIVE IS NOT TRANSFERRED DUE TO UNTOOTHED PORTION 38b | FORWARD ROTATION | PRESS-CONTACTED |
| S2 | | ON | | | | | ↑ | ↑ | ↑ |
| S3 | | | REVERSE ROTATION | → SWITCHING ENABLE POSITION<br>→ REVERSE ROTATION DRIVE POSITION | STOP | STOP | ↑ | STOP | ↑ |
| S4 | | | FORWARD ROTATION | → FORWARD ROTATION DRIVE POSITION | | FORWARD ROTATION | ↑ | FORWARD ROTATION | ↑ |
| S5 | | OFF | | | | | | ↑ | ↑ |
| S6 | | | STOP | | | | | STOP | ↑ |
| S7 | SWITCHBACK (REVERSING) PATH | | REVERSE ROTATION | REVERSE ROTATION DRIVE POSITION | | STOP→ FORWARD ROTATION (BY 22b) | GEAR PORTION 38h FACES UNTOOTHED PORTION 38a | REVERSE ROTATION | ↑ |
| S8 | | ON | | | | | | ↑ | ↑ |
| S9 | | | FORWARD ROTATION | | | STOP→ FORWARD ROTATION (BY 22a) | 36a≠38j | FREE | ↑ |
| | PASS BY | | FORWARD ROTATION | FORWARD ROTATION DRIVE POSITION | | FORWARD ROTATION | | FORWARD ROTATION | SEPARATED |
| | | | | | | | DRIVE IS NOT TRANSFERRED DUE TO UNTOOTHED PORTION 38b | ↑ | PRESS-CONTACTED |
| S10 | | OFF | | | | | | ↑ | ↑ |
| | COMPLETION OF DISCHARGE | | | | | | | ↑ | ↑ |
| S11 | | | REVERSE ROTATION | SWITCHING ENABLE POSITION | | | | STOP | ↑ |
| S12 | | | | | | | | ↑ | ↑ |

SHEET CONVEYING DEVICE

BACKGROUND OF THE INVENTION

1. Field of the Invention

The present invention relates to a sheet conveying device capable of executing switchback conveyance of a sheet.

2. Description of the Related Art

Some copying machines, facsimile apparatuses, multi function printers (to be referred to as an MFP hereinafter) or document scanners include an automatic document reading apparatus (to be referred to as an ADF hereinafter) that feeds stacked document sheets one by one and reads image information. Some of the ADFs include a sheet conveying device capable of automatically inverting a document in the device and reading its both surfaces. As one of the arrangements of the ADFs, a document whose one surface has been read is inverted via a switchback conveyance path to read the other surface.

From the viewpoint of cost reduction, an arrangement has recently been demanded which implements the switchback operation by driving the ADF using a single driving source without using any expensive electrical components such as an electromagnetic clutch and a solenoid plunger. In addition, since the product needs to be compact to save the space, the ADF also reduces its size. As a result, the first half portion of a document that has been led in and read and the second half portion of the document yet to be read pass by each other in the same path. It is therefore necessary to separate the rollers for switchback.

Japanese Patent Laid-Open No. 2007-230657 discloses an ADF that performs switchback conveyance to invert a document, thereby reading both surfaces of the document. The separation means for separating a pair of discharge rollers is formed from a cam and a lever that swings along the cam face. The cam face is provided so as to drive the separation means at such a timing that allows the document to reach a pair of conveyance rollers at the time of switchback. There is disclosed a method of mechanically controlling, using the cam face, the timing the document reaches the pair of conveyance rollers from the start of switchback until the pair of discharge rollers separate and the motor rotates in the reverse direction and the timing the pair of discharge rollers separate in the above-described arrangement.

In the technique of Japanese Patent Laid-Open No. 2007-230657, however, if the document slips during switchback or is misaligned at the start of switchback due to an error of the document edge detection sensor or the like, the document may be unable to reach a pair of intermediate rollers (for example, the pair of conveyance rollers) at the assumed timing. In this case, a pair of forward/reverse rotation rollers (for example, the pair of discharge rollers) may separate and lose the conveyance capability before the pair of intermediate rollers nip, resulting in document jam. To prevent this, the delay time set for the cam face and the time until the pair of intermediate rollers nip need to be exactly managed. This leads to severe requirements of dimensional accuracy of cam parts and conveyance accuracy of rollers and thus makes it difficult to increase the productivity.

Setting a longer delay time for the cam face allows to solve the above-described problem. However, since the pair of forward/reverse rotation rollers do not separate for some time after passing through the nip of the pair of intermediate rollers, the document needs to be conveyed by reverse rotation for some time up to the position where the forward/reverse rotation of the motor can be switched. If the step in which the rotation direction of the motor needs to be switched is to be arranged next to the pair of intermediate rollers, it is necessary to separate the step from the pair of intermediate rollers. This may make it difficult to simultaneously implement the arrangement and downsizing of the device.

SUMMARY OF THE INVENTION

The present invention provides a mechanism that does not require exact management of the separation timing of a pair of forward/reverse rotation rollers and the sheet conveyance accuracy for switchback conveyance of a sheet in a sheet conveying device capable of implementing switchback conveyance of a sheet using a single driving source.

According to an aspect of the present invention, there is provided a sheet conveying device comprising: a pair of first rollers and a pair of second rollers both configured to convey a sheet; a first conveyance path configured to convey the sheet from the pair of first rollers to the pair of second rollers; a second conveyance path configured to perform switchback conveyance of the sheet from the pair of second rollers to the pair of first rollers; a rollers-contacting/separating switching unit configured to switch the pair of second rollers between a press-contacted state and a separated state; and a single driving source configured to drive the pair of first rollers, the pair of second rollers, and the rollers-contacting/separating switching unit, wherein the pair of first rollers is rotatably driven in a direction in which the sheet is conveyed toward the first conveyance path independently of a rotation direction of the driving source, the pair of second rollers is switched to a direction corresponding to the rotation direction of the driving source, a non transferring of drive section is set where when the driving source switches the rotation direction after the sheet that has been switchback-conveyed has reached the pair of first rollers, a drive from the driving source is not transferred to the pair of second rollers, and the rollers-contacting/separating switching unit is driven to separate the pair of second rollers during a time the drive is not transferred to the pair of second rollers due to the non transferring of drive section.

Further features of the present invention will become apparent from the following description of exemplary embodiments (with reference to the attached drawings).

BRIEF DESCRIPTION OF THE DRAWINGS

FIG. 13 is a table showing the state of each unit in each step of FIG. 12.

DESCRIPTION OF THE EMBODIMENTS

The embodiment of the present invention will now be described in detail by way of example with reference to the accompanying drawings. Note that in some cases, an image reading apparatus is provided and used in the main body of an image recording apparatus such as a copying machine, a printer, a facsimile apparatus, or a multi function peripheral including them as part of the constituent elements of the image recording apparatus. In this case, information read by the image reading apparatus is recorded as an image on a sheet by the image recording section (image recording means) of the image recording apparatus. That is, the image read by the image reading apparatus is copied to a sheet by the image recording section. The sizes, materials, shapes, and relative arrangements of the constituent components described in the following embodiment should properly be changed depending on various conditions and the arrangement of the apparatus to which the present invention is applied, and the present invention is not limited to the scope.

In this embodiment, an automatic feeding and reading apparatus will be exemplified, which serves as an image reading apparatus including a sheet conveying device to which the present invention is applied.

Figure 1:
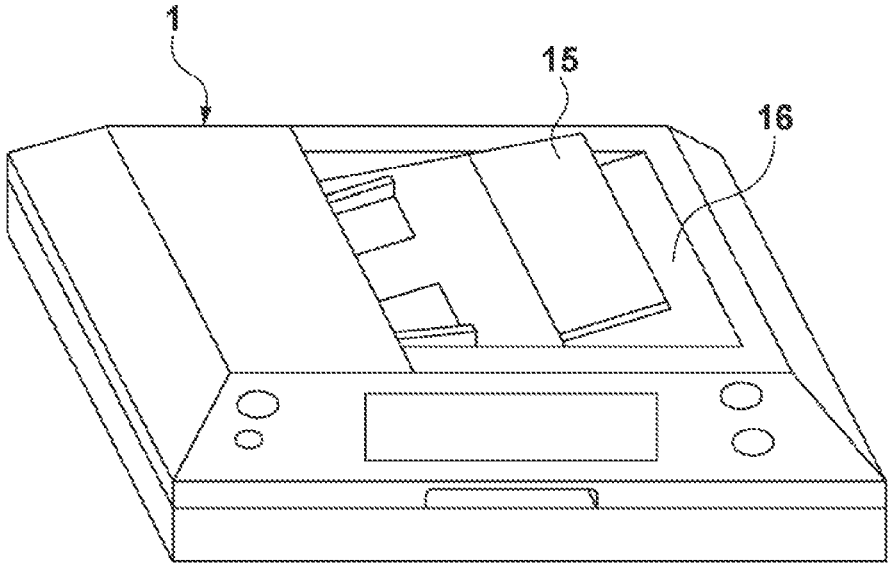
FIG. 1 is a perspective view showing the outer appearance of an automatic feeding and reading apparatus according to an embodiment of the present invention.
Figure 2:
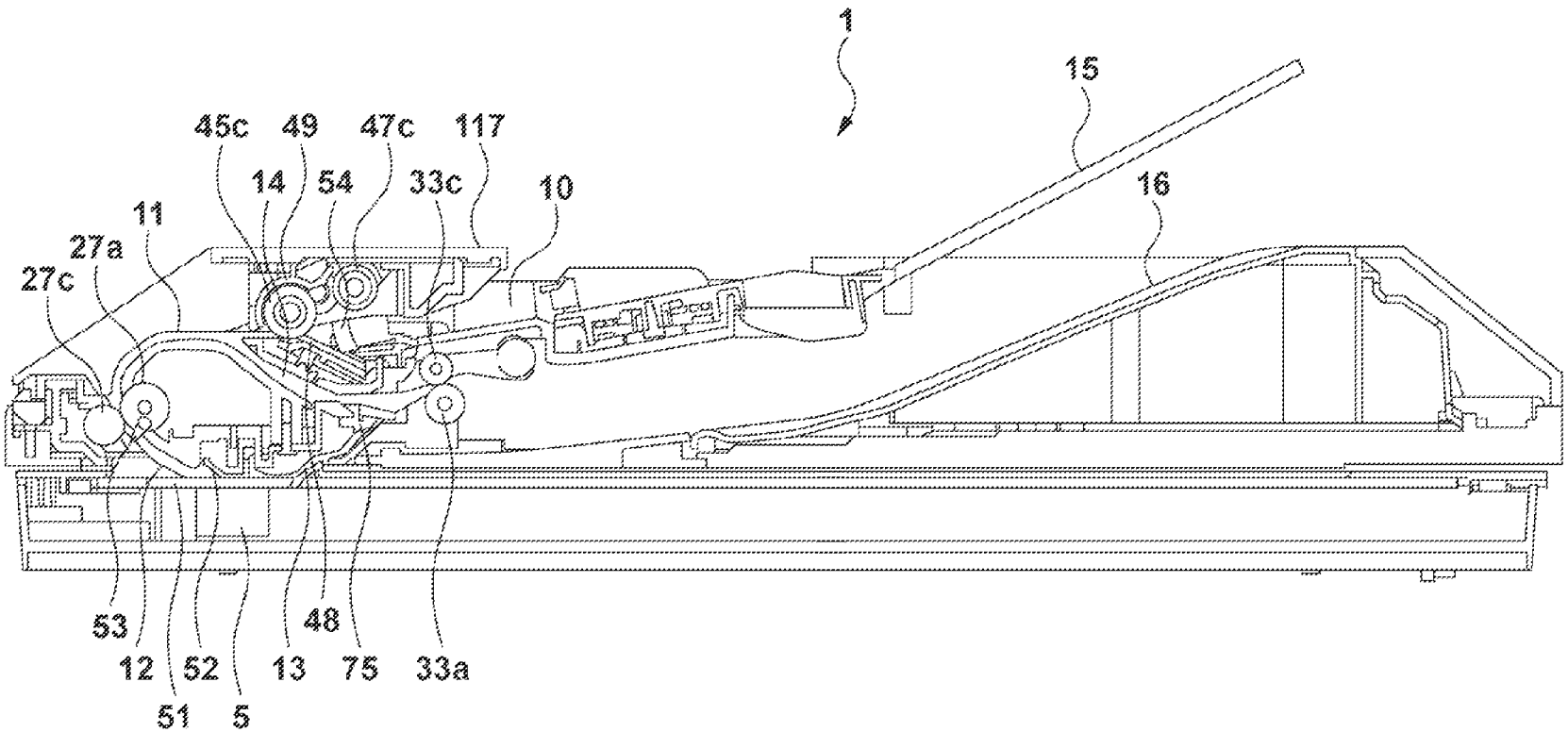
FIG. 2 is a sectional view showing the schematic arrangement of the automatic feeding and reading apparatus.
Figure 3:
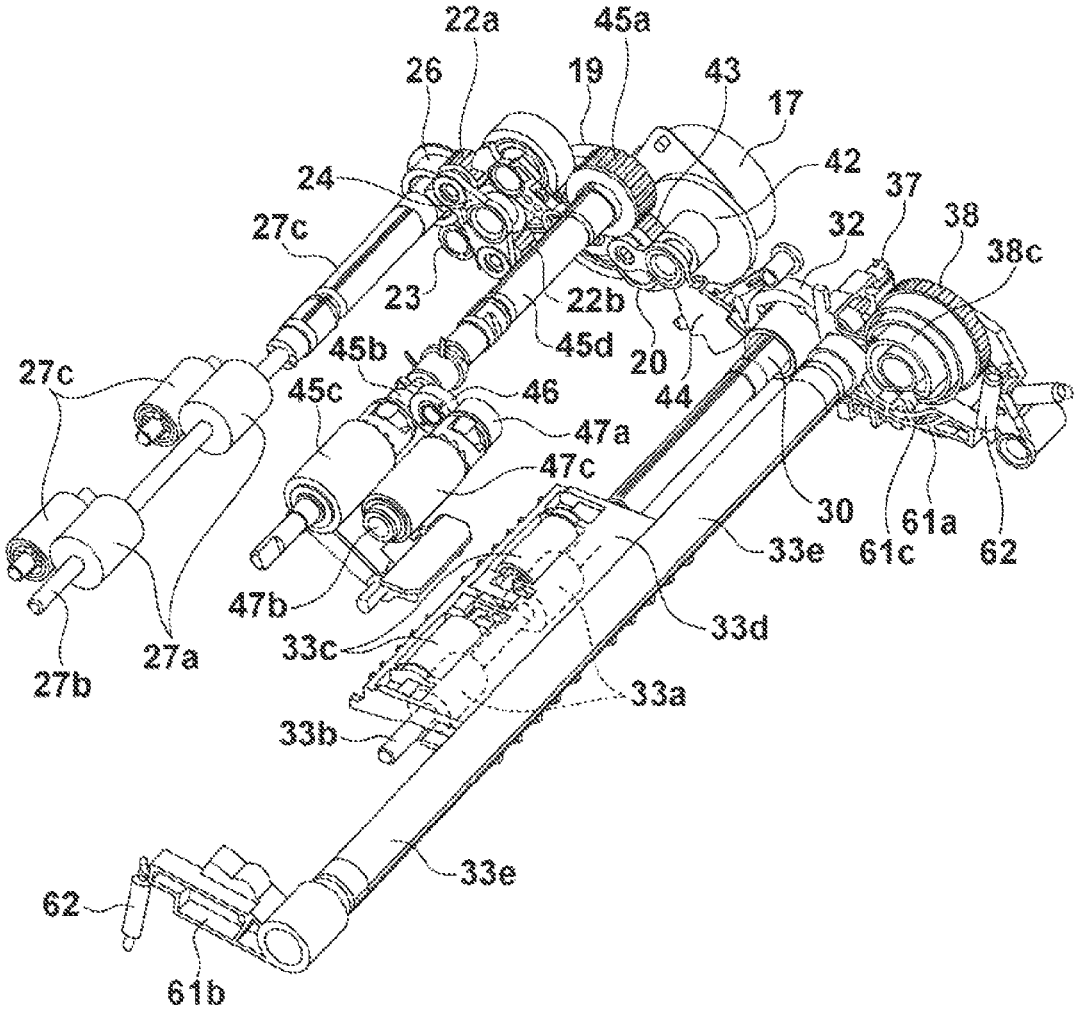
FIG. 3 is a perspective view showing the rollers and the chain of driving gears of the automatic feeding and reading apparatus.

FIG. 1 is a perspective view showing the outer appearance of the automatic feeding and reading apparatus according to this embodiment. FIG. 2 is a sectional view showing the schematic arrangement of the automatic feeding and reading apparatus according to this embodiment. FIG. 3 is a perspective view showing the rollers and the chain of driving gears of the automatic feeding and reading apparatus. First, the arrangement of the automatic feeding and reading apparatus will be explained with reference to FIGS. 1 to 3.

An automatic feeding and reading apparatus 1 includes a document feed tray 15 provided on the apparatus, and a document discharge tray 16 provided under the document feed tray 15. A document feed path 10 (conveyance path), a document conveyance path 11, a document reading path 12, and a document discharge path 13 are sequentially arranged in an almost U shape between the document feed tray 15 and the document discharge tray 16. The conveyance path 11 constitutes a third conveyance path. The document reading path 12 and the document discharge path 13 constitute a second conveyance path.

A document reversing path 14 is provided between the document feed path 10 and the document reading path 12. The document reversing path 14 connects the document discharge path 13 and the document conveyance path 11. A path switching flapper 75 is disposed between the document discharge path 13 and the document reversing path 14.

The path switching flapper 75 is configured to be swingable and face up so as to open the document discharge path 13 or face down so as to open the document reversing path 14. The path switching flapper 75 normally faces down due to the weight of its own.

The document feed path 10 includes a separation roller 45*c* and a pickup roller 47*c*. A separation pad 48 contacts the lower portion of the separation roller 45*c* due to the action of a spring (not shown). The arrangement including the separation roller 45*c* and the separation pad 48 constitutes a sheet separating section that separates and feeds stacked sheets. The document conveyance path 11 includes conveyance rollers 27*a*. Conveyance idler rollers 27*c* rotatably contact the conveyance rollers 27*a* due to the action of a spring (not shown). The conveyance rollers 27*a* and the conveyance idler rollers 27*c* constitute first pairs of rollers (first conveyance means).

A document reading platen glass 51 is provided under the document reading path 12. A document reading section 5 is provided under the document reading platen glass 51. A document pressing member 52 is provided on the document reading platen glass 51. A document is conveyed between the document reading platen glass 51 and the document pressing member 52.

In the document reading section 5, the conveyed document is irradiated with light from a light source such as an LED via the document reading platen glass 51. A lens array condenses the reflected light. A contact image sensor (to be referred to as a CIS hereinafter) then causes a reading means such as a CCD to photoelectrically convert the light, thereby reading the document image.

The document discharge path 13 includes discharge rollers 33*a*. Discharge idler rollers 33*c* are rotatably supported by a discharge idler roller holder 33*d* and contact the discharge rollers 33*a*. The discharge rollers 33*a* and the discharge idler rollers 33*c* constitute second pairs of rollers (second conveyance means). The discharge idler roller holder 33*d* includes a shaft portion 33*e* and is pivotally supported about the shaft portion 33*e* so as to be swingable.

Discharge idler roller holder levers 61*a* and 61*b* are attached to the two ends of the shaft portion 33*e*. Hooks are provided at the distal ends of the discharge idler roller holder levers 61*a* and 61*b*. A spring 62 is attached to each hook. The springs 62 are attached such that the spring force acts to swing the discharge idler roller holder 33*d* toward the discharge rollers 33*a* so as to press the discharge idler rollers 33*c* against the discharge rollers 33*a*.

A cam follower 61*c* engaging with a cam face 38*c* of a discharge cam gear 38 to be described later is provided on the discharge idler roller holder lever 61*a* on the side of the chain of drives.

Figure 4:
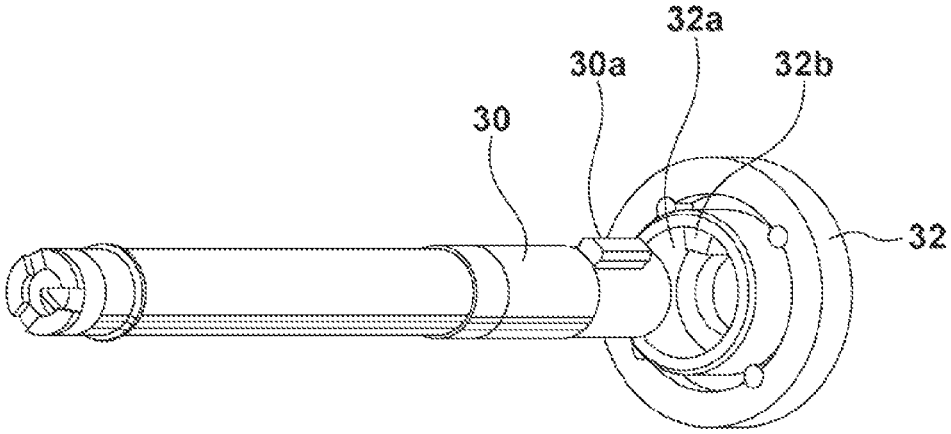
FIG. 4 is a perspective view for explaining a delaying mechanism.
Figure 5:
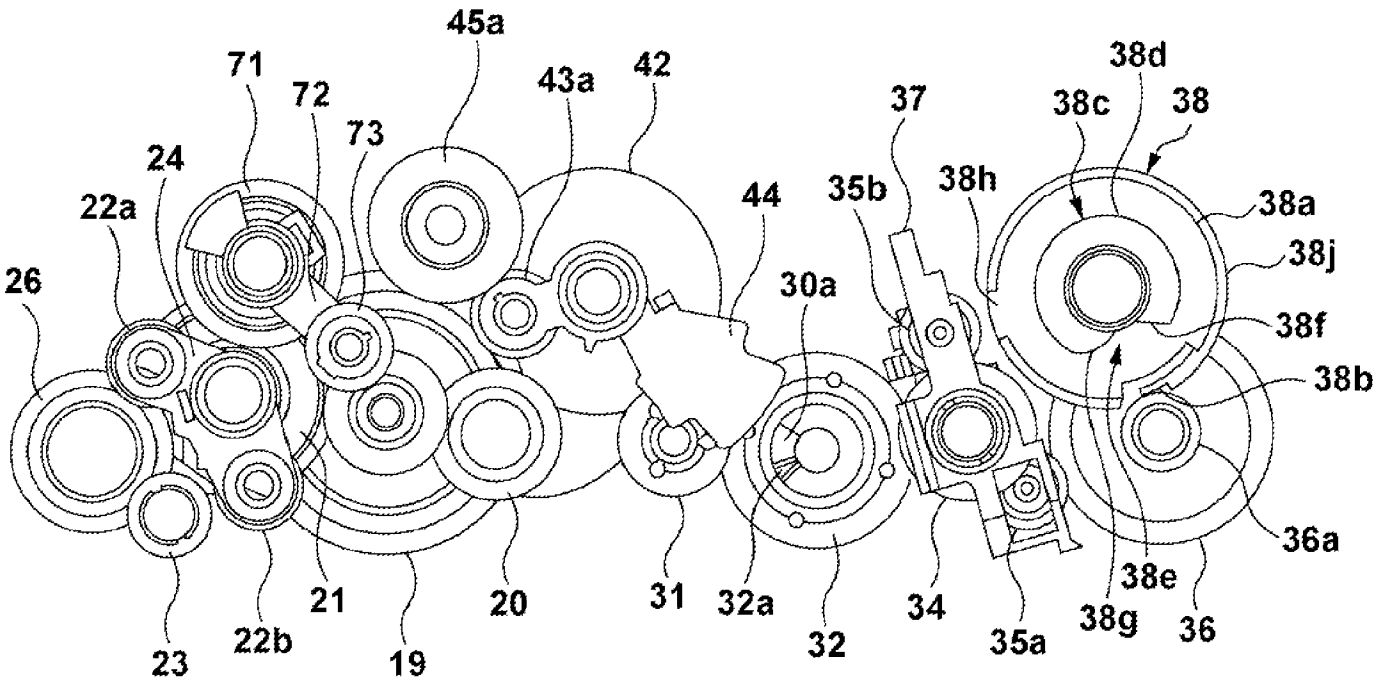
FIG. 5 is a schematic view showing a chain of drives when the motor rotates in the forward direction.
Figure 6:
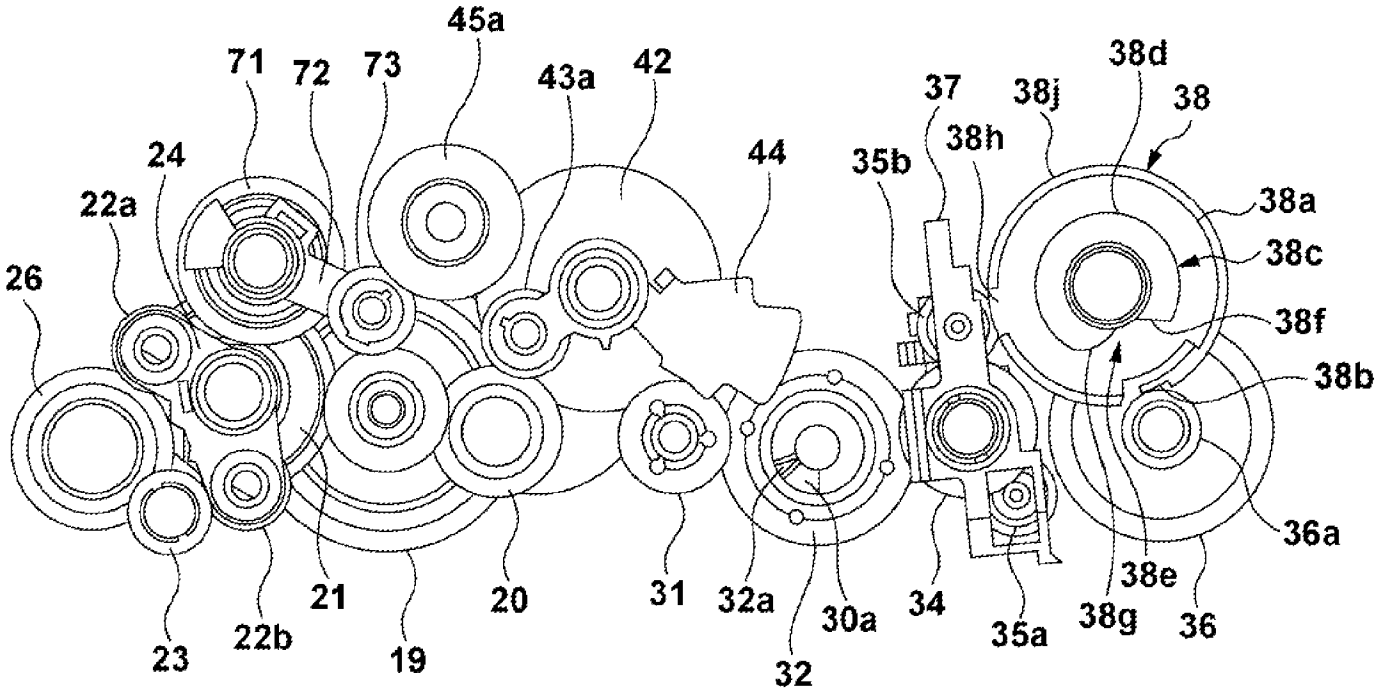
FIG. 6 is a schematic view showing the chain of drives when the motor rotates in the reverse direction.

FIG. 4 is a perspective view for explaining a delaying mechanism. FIG. 5 is a schematic view showing a chain of gears when the motor of the automatic feeding and reading apparatus according to this embodiment rotates in the forward direction. FIG. 6 is a schematic view showing the chain of gears when the motor of the automatic feeding and reading apparatus according to this embodiment rotates in the reverse direction. The arrangement of the chain of drives for feeding documents according to this embodiment will be described with reference to FIGS. 3 to 6.

A chain 2 of drives for feeding documents includes a motor 17 serving as the sole (single) driving source of the chain 2 of drives for feeding documents and capable of rotating in the forward and reverse directions. A motor gear (not shown) is attached to the motor 17. The motor gear meshes with a conveyance sun gear 21 through an idler gear 19. A conveyance planet gear arm 24 swingable about the axis is attached to the conveyance sun gear 21. Conveyance planet gears 22*a* and 22*b* are rotatably attached to the conveyance planet gear arm 24 to as to mesh with the conveyance sun gear 21. As the conveyance sun gear 21 and the conveyance planet gear arm 24 swing, the conveyance planet gear 22*a* meshes with a conveyance roller gear 26, and the conveyance planet gear

22*b* meshes with a conveyance planet-idler gear 23. The conveyance planet-idler gear 23 meshes with the conveyance roller gear 26. The conveyance rollers 27*a* are coaxially fixed on a conveyance roller shaft 27*b*. The conveyance roller gear 26 is coaxially supported at an end of the conveyance roller shaft 27*b* so as to mesh with the conveyance planet-idler gear 23. In this arrangement, the conveyance rollers 27*a* and the conveyance idler rollers 27*c* are rotatably driven in the direction in which the sheet is conveyed toward the document reading path 12 independently of the rotation direction of the motor 17. The chain of gears from the conveyance sun gear 21 to the conveyance roller gear 26 constitutes a first transfer means.

The discharge rollers 33*a* are coaxially fixed on a discharge roller shaft 33*b*. A discharge roller driving shaft 30 serving as a second rotation member is coaxially supported at an end of the discharge roller shaft 33*b*. A discharge roller gear 32 serving as a first rotation member faces the discharge roller driving shaft 30 and freely fits on the discharge roller shaft 33*b* so as to be rotatable. A protruding portion 30*a* serving as a convex portion is provided on the discharge roller driving shaft 30. The protruding portion 30*a* is formed to protrude toward the discharge roller gear 32 in the axial direction. The discharge roller gear 32 has a concave portion 32*a* that receives the protruding portion 30*a*, and a protruding portion 32*b* formed to be concyclic with the concave portion and engage with the protruding portion 30*a*. The engaging portion between the protruding portion 30*a* and the concave portion 32*a* is formed with a backlash so as to cause the discharge roller gear 32 and the discharge roller driving shaft 30 to have a play in the rotation direction. The discharge roller gear 32 and the discharge roller driving shaft 30 constitute a second transfer means.

The circumferential length of the concave portion 32*a* is set to be longer than that of the protruding portion 30*a*. For this reason, the discharge roller driving shaft is at rest until the protruding portions 30*a* and 30*b* engage with each other (non transferring of drive section), and is then driven with a delay with respect to the rotation of the discharge roller gear 32. That is, when the rotation direction of the discharge roller gear 32 is switched, the driving force is transferred to the discharge rollers 33*a* with a delay. Hence, the discharge rollers 33*a* always start moving with a delay of a predetermined time. The mechanism that is formed from the discharge roller driving shaft 30 and the discharge roller gear 32 and moves as described above will be referred to as a delaying mechanism hereinafter.

The discharge roller gear 32 meshes with a discharge cam sun gear 34. A discharge cam planet gear arm 37 swingable about the axis is attached to the discharge cam sun gear 34. Discharge cam planet gears 35*a* and 35*b* are rotatably attached to the discharge cam planet gear arm 37. The discharge cam sun gear 34 meshes with the discharge cam planet gears 35*a* and 35*b*.

As the discharge cam sun gear 34 rotates, the discharge cam planet gear arm 37 swings. That is, the discharge cam planet gear arm 37 swings to make the discharge cam planet gear 35*a* mesh with a discharge cam planet idler gear 36 when the motor 17 rotates in the forward direction and make the discharge cam planet gear 35*b* mesh with the discharge cam gear 38 when the motor 17 rotates in the reverse direction. The discharge cam gear 38 is provided with a first gear portion including an untoothed portion 38*a* and a gear portion 38*h*, and a second gear portion including an untoothed portion 38*b* and a gear portion 38*j*. In the initial state, the untoothed portion 38*b* faces a pinion 36*a* of the discharge cam planet idler gear 36. Even when the motor 17 rotates in the forward direction, the teeth do not mesh with each other. Hence, the drive of the discharge cam planet idler gear 36 is not transferred to the discharge cam gear 38.

On the other hand, the discharge cam gear 38 has the gear portion 38*h* corresponding to a predetermined number of teeth at a position facing the discharge cam planet gear 35*b*, and the untoothed portion 38*a* otherwise. When the motor 17 rotates in the reverse direction, the discharge cam sun gear 34 rotates clockwise to swing the discharge cam planet gear arm 37 clockwise. The gear portion 38*h* of the discharge cam gear 38 meshes with the discharge cam planet gear 35*b* so as to rotatably drive the discharge cam gear 38 by an amount corresponding to the predetermined number of teeth. After that, the untoothed portion 38*a* of the discharge cam gear 38 reaches the position facing the discharge cam planet gear 35*b*, transfer of the drive from the motor to the discharge cam gear 38 stops, and the discharge cam gear 38 stops rotating. At this time, since the discharge cam gear 38 rotates by the amount corresponding to the several teeth, the untoothed portion 38*b* at the position facing the discharge cam planet idler gear 36 moves so that the gear portion 38*j* meshes with the pinion 36*a* of the discharge cam planet idler gear 36.

When the rotation of the motor 17 is then switched to the forward direction, the discharge cam planet gear arm 37 swingably rotates counterclockwise to make the discharge cam planet gear 35*a* mesh with the discharge cam planet idler gear 36 and rotatably drive the discharge cam planet idler gear 36. Since the pinion 36*a* of the discharge cam planet idler gear 36 meshes with the discharge cam gear 38 this time, the discharge cam gear 38 is rotatably driven. After that, the discharge cam gear 38 is rotatably driven until the discharge cam planet idler gear 36 reaches the untoothed portion 38*b*. Transfer of the drive to the discharge cam gear 38 stops when the untoothed portion 38*b* reaches the position facing the discharge cam planet idler gear 36. The discharge cam gear 38 stops, thus restoring the initial state.

The discharge cam gear 38 has the cam face 38*c*. The above-described cam follower 61*c* of the discharge idler roller holder lever 61*a* is arranged at the position facing the cam face 38*c*. The cam face 38*c* includes an arc portion 38*d* concentric to the discharge cam gear 38, and a concave portion 38*e* connected to the arc portion 38*d* via inclined surfaces 38*f* and 38*g*.

In the initial state, the concave portion 38*e* is located at the position facing the cam follower 61*c*, and the cam face 38*c* and the cam follower 61*c* are in a disengaged state. When the discharge cam gear 38 rotates, the inclined surface 38*f* of the cam face 38*c* engages with the cam follower 61*c* and starts pushing the discharge idler roller holder lever 61*a* down against the spring force of the spring 62.

This makes the discharge idler roller holder 33*d* pivot about the shaft portion 33*e* so the discharge idler rollers 33*c* gradually rise and start separating from the discharge rollers 33*a*. The pivotal movement of the discharge idler roller holder 33*d* ends, thus completing the separation operation between the discharge rollers 33*a* and the discharge idler rollers 33*c* when the cam follower 61*c* reaches the arc portion 38*d* of the cam face 38*c*. That is, the arrangement including the cam face 38*c* of the discharge cam gear 38, the cam follower 61*c* of the discharge idler roller holder lever 61*a*, and the spring 62 constitutes a rollers-contacting/separating switching means for switching the discharge rollers 33*a* and the discharge idler rollers 33*c* between a press-contacted state and a separated state.

When the discharge cam gear 38 further rotates, the inclined surface 38*g* engages with the cam follower 61*c*. The discharge idler roller holder lever 61*a* is moved upward by the spring force so as to make a movement reverse to that described above. After a while, the discharge rollers 33*a* are pressed against the discharge idler rollers 33*c*, and the cam face 38*c* disengages from the cam follower 61*c*, thus restoring the initial state.

The idler gear 19 meshes with a feeding sun gear 42 via an idler gear 20. A feeding planet gear arm 44 swingable about the axis is attached to the feeding sun gear 42. A feeding planet gear 43*a* is rotatably attached to the feeding planet gear arm 44 to mesh with the feeding sun gear 42. When the motor 17 rotates in the forward direction, the feeding sun gear 42 swings to make a separation roller gear 45*a* mesh with the feeding planet gear 43*a*. A separation roller shaft 45*d* is coaxially fixed at the rotation center of the separation roller gear 45*a*.

A separation roller 45*c* and a separation roller gear 45*b* are coaxially fixed on the separation roller shaft 45*d* on the side of the document feed path 10. A pickup gear 47*a* meshes with the separation roller gear 45*b* via a pickup idler gear 46. A pickup roller 47*c* is coaxially fixed at the rotation center of the pickup gear 47*a* via a pickup shaft 47*b*.

A pickup holder 49 integrally supports the pickup gear 47*a*, the pickup shaft 47*b*, the pickup roller 47*c*, and the pickup idler gear 46. A spring clutch (not shown) is attached across the pickup holder 49 and the separation roller shaft 45*d*.

A feeding sun gear 71 meshes with the conveyance roller gear 26. A feeding planet gear arm 72 swingable about the axis is attached to the feeding sun gear 71. A feeding planet gear 73 is attached to the feeding planet gear arm 72 and meshes with the feeding sun gear 71. When the motor 17 rotates in the forward direction, the feeding sun gear 71 swings to make the separation roller gear 45*a* mesh with the feeding planet gear 73.

Figure 8:
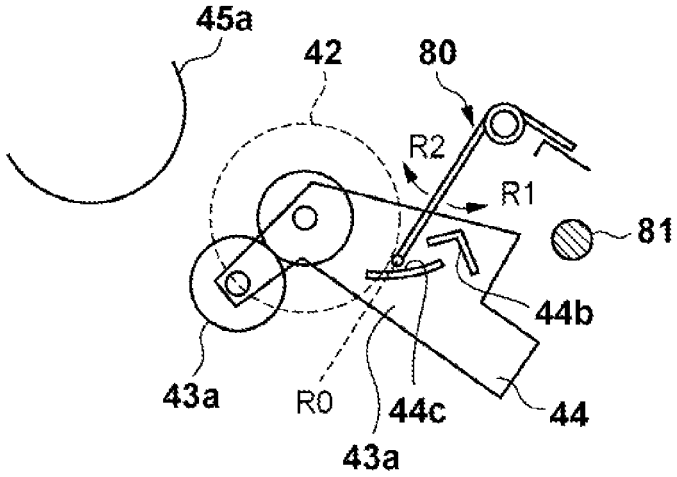
FIG. 8 is a view showing details of a feeding planet gear arm 44.

FIG. 8 is a view for explaining details of the feeding planet gear arm 44. FIGS. 9A to 9D are views for explaining a document feeding operation. The feeding planet gear 43*a* is rotatably pivotally supported by the feeding planet gear arm 44 and arranged to mesh with the separation roller gear 45*a*. The feeding planet gear 43*a* is thus configured to rotate while meshing with the feeding sun gear 42 and swing about the rotation center of the feeding sun gear 42, and pivots in accordance with the forward/reverse driving of the motor 17.

The separation roller gear 45*a* is arranged on the pivotal orbit of the feeding planet gear 43*a* and configured to mesh with the feeding planet gear 43*a*. A control lever 80 engages with the feeding planet gear arm 44 to regulate the pivotal movement of the arm. The control lever 80 is formed from a helical torsion spring. A coil portion 80*a* is supported by the device main body. A lever portion 80*b* is flexible about the support portion and can be bent by the pressing force in the direction of an arrow R1 or an arrow R2 in FIG. 8. The lever portion 80*b* is also configured to be located at an initial position R0 by the spring force of the coil portion 80*a*.

The spring force of the helical coil portion 80*a* is set such that it is bent by a force of several thousand dyn (dyne). The feeding planet gear arm 44 is provided with cam faces 44*a*, 44*b*, and 44*c*. The lever portion 80*b* has, at its distal end, a cam follower 80*c* that engages with the cam faces 44*a*, 44*b*, and 44*c*. A stopper member 81 is configured to abut against the cam face 44*a* serving as the butt portion of the feeding planet gear arm 44 and not to pivot anymore counterclockwise in FIG. 8. The feeding planet gear arm 44 engages with the separation roller gear 45*a* that pivots clockwise in FIG. 8.

The pivotal movement of the feeding planet gear arm 44 is controlled by the cam follower 80*c* of the control lever 80 engaging with the cam faces 44*a*, 44*b*, and 44*c*. The feeding planet gear arm 44 is thus configured to transit between a reverse rotation drive position, a forward rotation drive position, a switching enable position, and a feeding position to be described later.

That is, the arrangement including the feeding planet gear arm 44 and the control lever 80 shown in FIG. 8 constitutes a separating-section-drive-switching means for connecting/disconnecting the drive to/from the sheet separating section via the separation roller gear 45*a*. The separating-section-drive-switching unit connects the drive to the sheet separating section only upon receiving the drive in a specific drive pattern by the combination of predetermined driving amounts of forward/reverse rotations of the motor 17. The drive is disconnected from the sheet separating section in accordance with the reverse drive in a predetermined driving amount or more. Details of this operation will be explained with reference to FIGS. 9A to 9D.

Figure 9B:
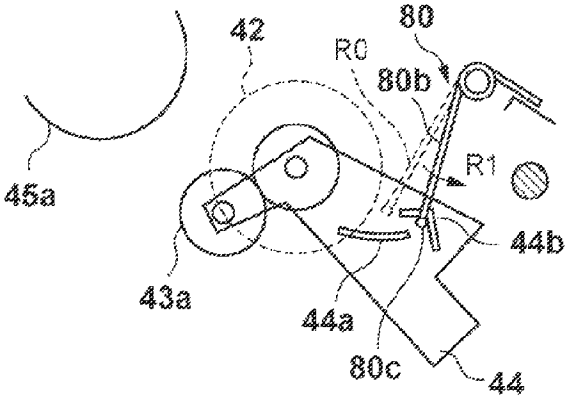
FIGS. 9A to 9D are views showing an operation of causing a swing arm to transit between positions.
Figure 9A:
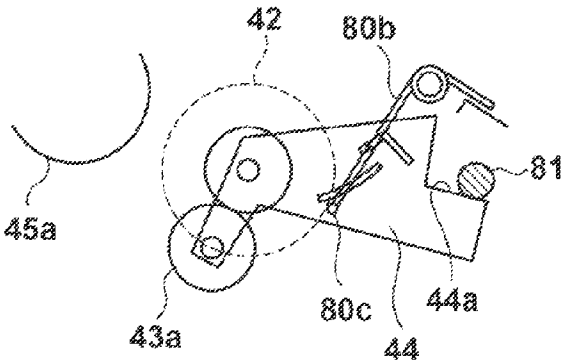

FIGS. 9A to 9D are views showing a state in which the feeding planet gear arm 44 transits between the positions. FIG. 9A shows a state in which the motor 17 rotates in the reverse direction to make the feeding planet gear arm 44 pivot counterclockwise, and the counterclockwise pivotal movement is regulated when the feeding planet gear arm 44 abuts against the stopper member 81. At this time, the feeding planet gear 43*a* meshes with nothing and is set in an idle running state at the position where the feeding planet gear arm 44 abuts and stops pivoting. This state will be referred to as a reverse rotation drive position hereinafter.

When the motor 17 rotates in the forward direction from the reverse rotation drive position, the feeding sun gear 42 rotates clockwise, and the feeding planet gear arm 44 also pivots clockwise. The cam follower 80*c* of the control lever 80 then contacts the cam face 44*a* of the feeding planet gear arm 44. When the feeding planet gear arm 44 further pivots clockwise, the cam follower 80*c* bends in the direction R1 along the cam face 44*a*. The feeding planet gear arm 44 continuously pivots clockwise while shoving the cam follower 80*c*.

When arriving at the end of the cam face 44*a*, the cam follower 80*c* disengages from the cam face 44*a*. The lever portion 80*b* of the control lever 80 is going to return to the initial position R0 due to the spring force, and engages with the cam face 44*b* arranged adjacent to the cam face 44*a*. The cam face 44*b* engages with the cam follower 80*c*. The cam follower 80*c* continuously stops the counterclockwise pivotal movement of the feeding planet gear arm 44. Even if the motor 17 continuously rotates in the forward direction, the feeding planet gear arm 44 maintains the stopped state, and the planet gear is set in the idle running state at that position (FIG. 9B). This state will be referred to as a forward rotation drive position hereinafter.

Figure 9D:
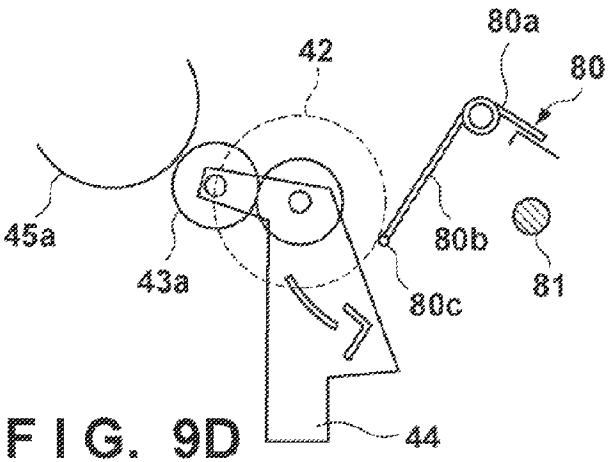
Figure 9C:
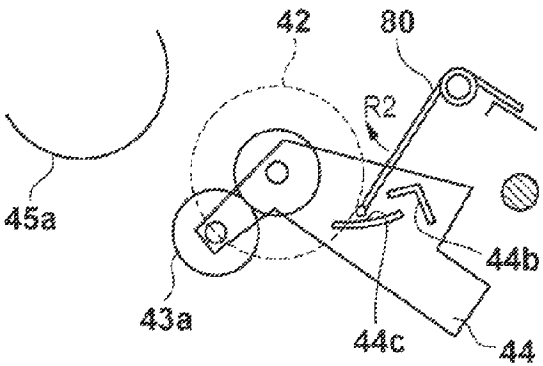

When the motor 17 rotates in the reverse direction from the forward rotation drive position, the feeding planet gear arm 44 starts pivoting counterclockwise. The cam follower 80*c* disengages from the cam face 44*b*, and the lever portion 80*b* returns to the initial position R0 due to the spring force (FIG. 9C).

When the motor 17 is further driven in the reverse direction, the feeding planet gear arm 44 pivots counterclockwise, and the cam follower 80*c* contacts the cam face 44*c*. The cam follower 80*c* bends in the direction R2 along the cam face 44*c* when the feeding planet gear arm 44 pivots clockwise. The feeding planet gear arm 44 continuously pivots counterclockwise while pushing the cam follower 80*c*.

When arriving at the end of the cam face 44*c*, the cam follower 80*c* disengages from the cam face 44*c*. The lever portion 80*b* of the control lever 80 returns to the initial position R0 due to the spring force. The feeding planet gear arm 44 pivots counterclockwise. When an end portion 44*d* abuts against the stopper member 81, the pivotal movement is stopped, and the feeding planet gear arm 44 returns to the reverse rotation drive position (FIG. 9A).

As described above, when the motor is driven in the reverse direction by a predetermined driving amount or more in the state in which the feeding planet gear arm 44 is at the forward rotation drive position, the feeding planet gear arm 44 is switched to and held at the reverse rotation drive position. In addition, when the motor is driven in the forward direction by a predetermined driving amount or more in the state in which the feeding planet gear arm 44 is at the reverse rotation drive position, the feeding planet gear arm is switched to and held at the forward rotation drive position.

When the motor 17 is driven in the reverse direction in the state in which the feeding planet gear arm 44 is at the forward rotation drive position, the feeding planet gear arm 44 pivots counterclockwise, the cam follower 80*c* disengages from the cam face 44*b*, and the control lever 80 returns to the initial position R0 (the chain line in FIG. 9B). When the rotation of the motor 17 is switched to the forward rotation in this state, the feeding planet gear arm 44 can further pivot clockwise beyond the forward rotation drive position without contacting the cam follower 80*c* (FIG. 9A). This state will be referred to as a switching enable position hereinafter.

When the motor 17 is further driven in the forward direction at the switching enable position, the feeding planet gear 43*a* approaches the separation roller gear 45*a*. The feeding planet gear 43*a* finally meshes with the separation roller gear 45*a* and drives the separation roller 45*c* via the separation roller shaft 45*d* (FIG. 9D). This state will be referred to as a feeding position hereinafter.

Figure 10:
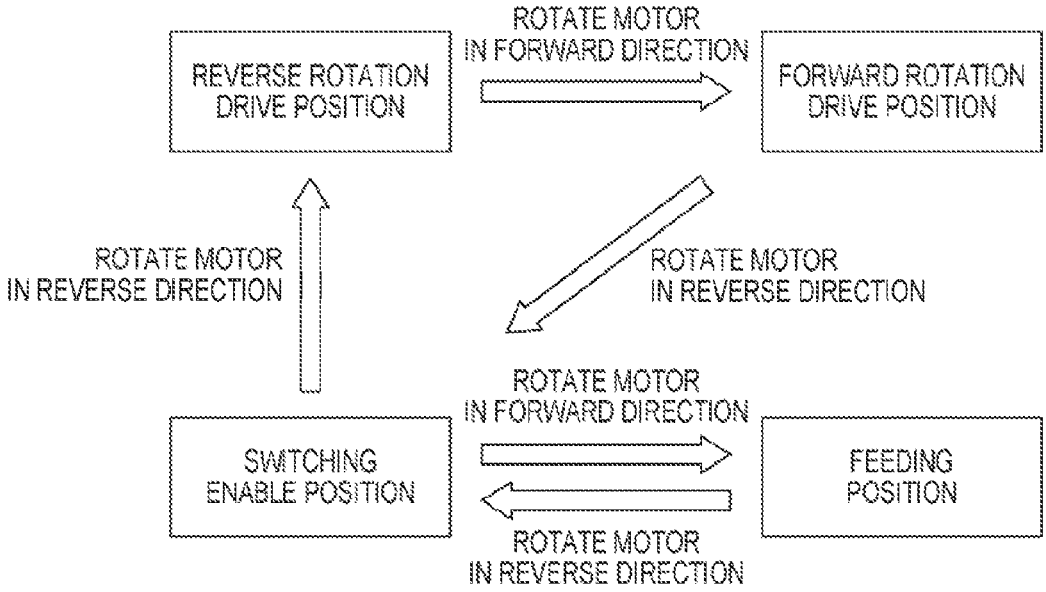
FIG. 10 is a view showing the relationship between a reverse rotation drive position, a forward rotation drive position, a switching enable position, and a feeding position.

When the motor is driven in the reverse direction in the state in which the feeding planet gear arm 44 is at the feeding position, the feeding planet gear arm 44 pivots counterclockwise, the feeding planet gear 43*a* disengages from the separation roller gear 45*a*, and the cam follower 80*c* contacts the cam face 44*c*. When the motor is further driven in the reverse direction, transition to the above-described reverse rotation drive position occurs. FIG. 10 illustrates the relationship between the reverse rotation drive position (FIG. 9A), the forward rotation drive position (FIG. 9B), and switching enable position (FIG. 9C), and the feeding position (FIG. 9D).

Figure 7A:
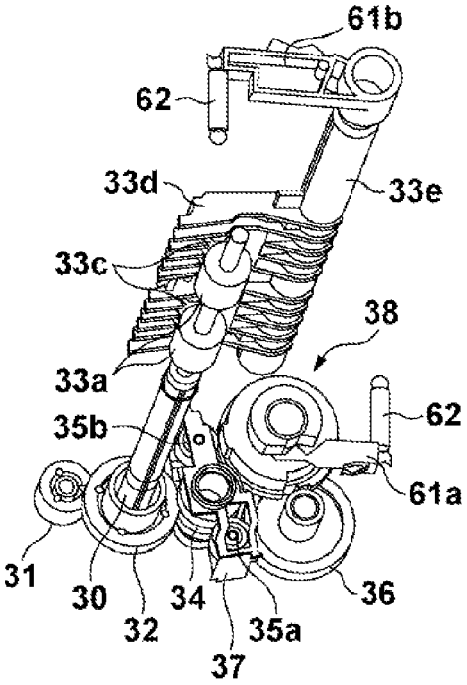
FIGS. 7A to 7C are perspective views showing a discharge roller separation operation and a cam operation.
Figure 7B:
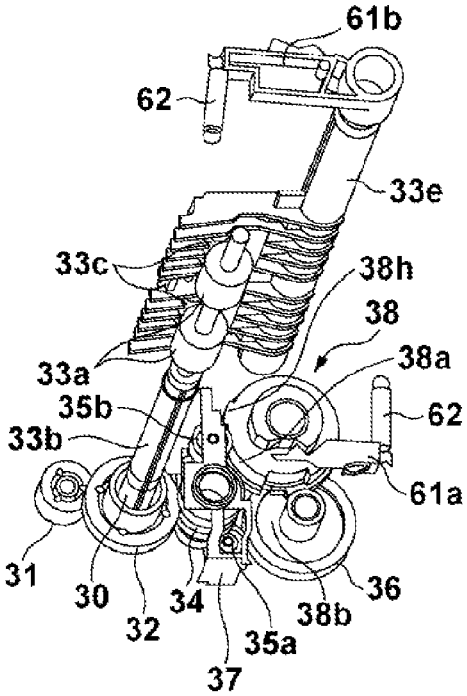
Figure 7C:
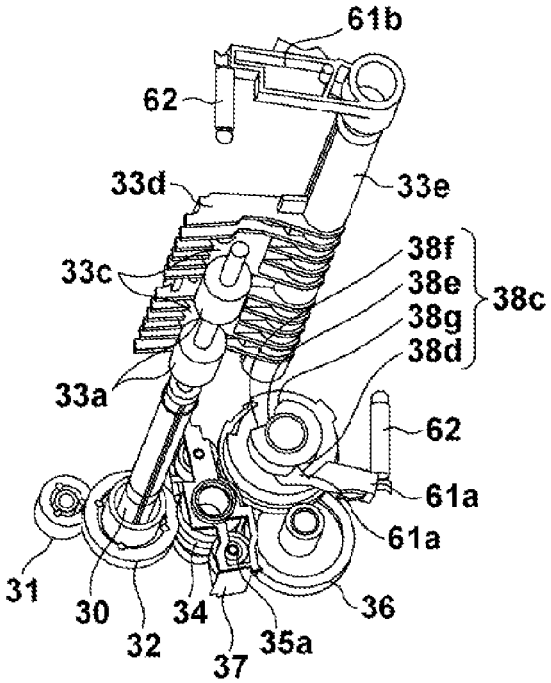

FIGS. 7A to 7C are perspective views showing the sandwiching and sandwich cancel states of the discharge rollers of the automatic feeding and reading apparatus according to this embodiment and the operation of the discharge cam gear.

A series of single-sided document reading operations of the automatic feeding and reading apparatus 1 will be described with reference to FIGS. 1 to 7C. A document is stacked on the document feed tray 15. At this time, the document is stacked with the reading surfaces facing up. The document feed tray 15 or the document feed path 10 is provided with a document presence/absence sensor 54 that detects that the document is stacked on the document feed tray 15.

Upon receiving a reading start instruction from an operation unit (not shown), the motor 17 and the motor gear start rotating. The rotation direction at this time is defined as the forward direction. The drive is transferred to the separation roller 45*c* sequentially via the motor gear, the idler gear 19, the idler gear 20, the feeding sun gear 42, the feeding planet gear 43*a*, the separation roller gear 45*a*, and the separation roller shaft 45*d*, as shown in FIG. 5.

One end of the pickup holder 49 is attached to the separation roller shaft 45*d*. When the separation roller shaft 45*d* rotates in the forward direction (the motor 17 rotates in the forward direction), the pickup holder 49 pivots to move the pickup roller 47*c* downward. When the pickup roller 47*c* contacts the document, the pickup holder 49 is set in the idle running state with respect to the separation roller shaft 45*d* due to the action of the spring clutch (not shown).

When the pickup roller 47*c* contacts the document, one or a plurality of document sheets stacked on the document feed tray 15 are fed from the top. If a plurality of document sheets are conveyed, the separation roller 45*c* contacts the separation pad 48 to reliably separate each sheet and convey it from the document feed path 10 to the conveyance rollers 27*a* in the document conveyance path 11.

The motor 17 continues rotating in the forward direction, and the drive is transferred to the conveyance rollers 27*a* sequentially via the motor gear, the idler gear 19, the conveyance sun gear 21, the conveyance planet gear 22*a*, the conveyance roller gear 26, and the conveyance roller shaft 27*b*. Hence, the conveyance rollers 27*a* continue rotating in the direction in which the document is conveyed. The conveyance idler rollers 27*c* are always kept in contact with the conveyance rollers 27*a* by the action of a spring (not shown). Hence, the document conveyed to the document conveyance path 11 is sandwiched between the conveyance rollers 27*a* and the conveyance idler rollers 27*c* and further conveyed to the document reading path 12.

The document reading path 12 (that is, the first conveyance path) is provided with a document edge sensor 53 serving as a sheet detection means for detecting that a sheet has reached a predetermined position on the downstream side of the conveyance rollers 27*a* and the conveyance idler rollers 27*c*. When the document edge sensor 53 detects the leading edge of the document, the document reading section 5 starts reading image information after the document has been conveyed by a predetermined amount from that position. At this time, the document that is being read is brought into tight contact with the document reading platen glass 51 by the document pressing member 52 and a spring (not shown). For this reason, the distance between the document reading section 5 and the reading surface of the document and is kept constant. This allows to read a clearer image. The document that has undergone the reading is conveyed to the document discharge path 13. The document moves while shoving up the path switching flapper 75 by the leading edge, and reaches the nip between the discharge rollers 33*a* and the discharge idler rollers 33*c*. The document is further conveyed onto the document discharge tray 16. After that, when the document edge sensor 53 detects the trailing edge of the document that is being read, the document reading section 5 ends image information reading after the document has been conveyed by a predetermined amount from that position.

The motor 17 continues rotating in the forward direction, and the drive is transferred to the discharge rollers 33*a* sequentially via the motor gear, the idler gear 19, the idler gear 20, the feeding sun gear 42, a discharge idler gear 31, the discharge roller gear 32, the discharge roller driving shaft 30, and the discharge roller shaft 33*b*. The discharge rollers 33*a* rotate in the direction in which the document is discharged to the document discharge tray 16.

During single-side reading, the discharge idler rollers 33*c* are always kept in contact with the discharge rollers 33*a* via the discharge idler roller holder 33*d* by the action of a spring (not shown), as shown in FIG. 7A. Hence, the document conveyed to the document discharge path 13 is sandwiched between the discharge rollers 33*a* and the discharge idler rollers 33*c* and conveyed to the document discharge tray 16. Note that the operation at the time of image reading and the operation of the discharge cam will be explained later. In this way, the automatic feeding and reading apparatus 1 repeats the above-described reading operation until the document presence/absence sensor 54 detects that there is no document stacked on the document feed tray 15 any more.

Figure 11:
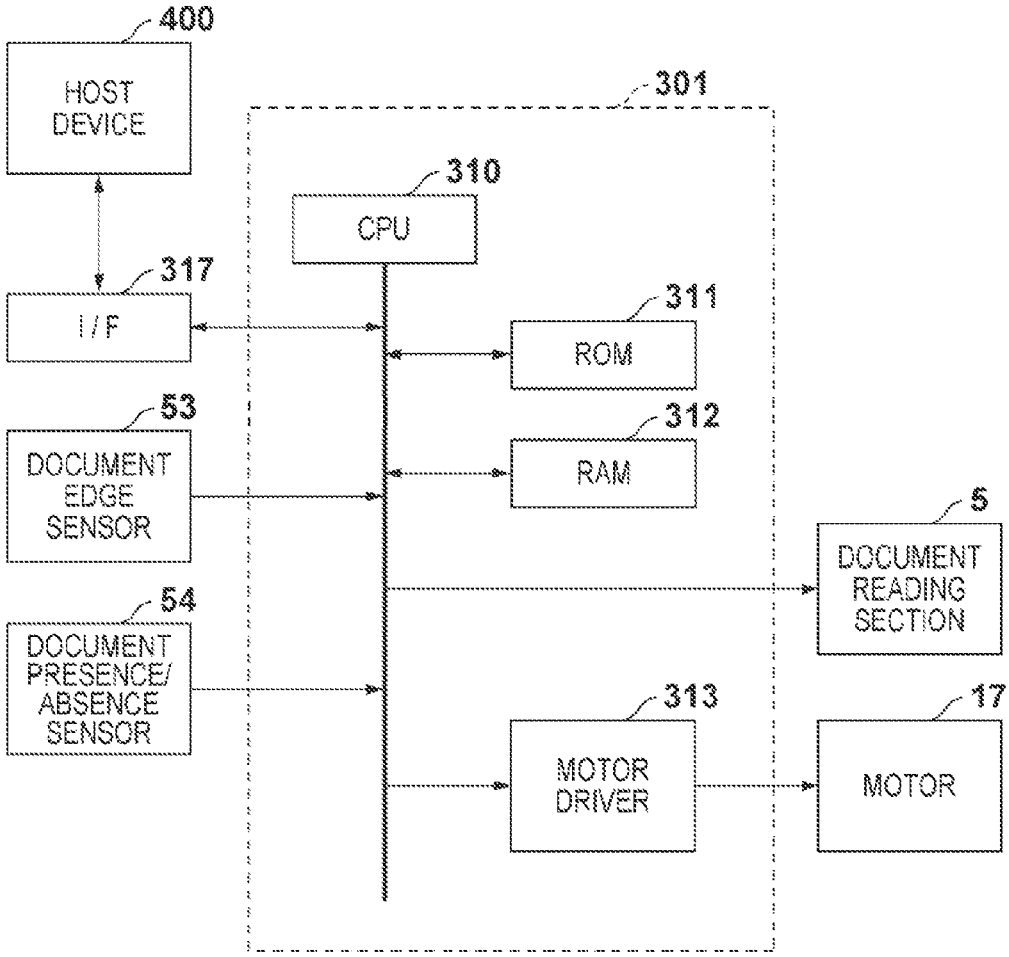
FIG. 11 is a block diagram of the control unit of the automatic feeding and reading apparatus.
Figure 12:
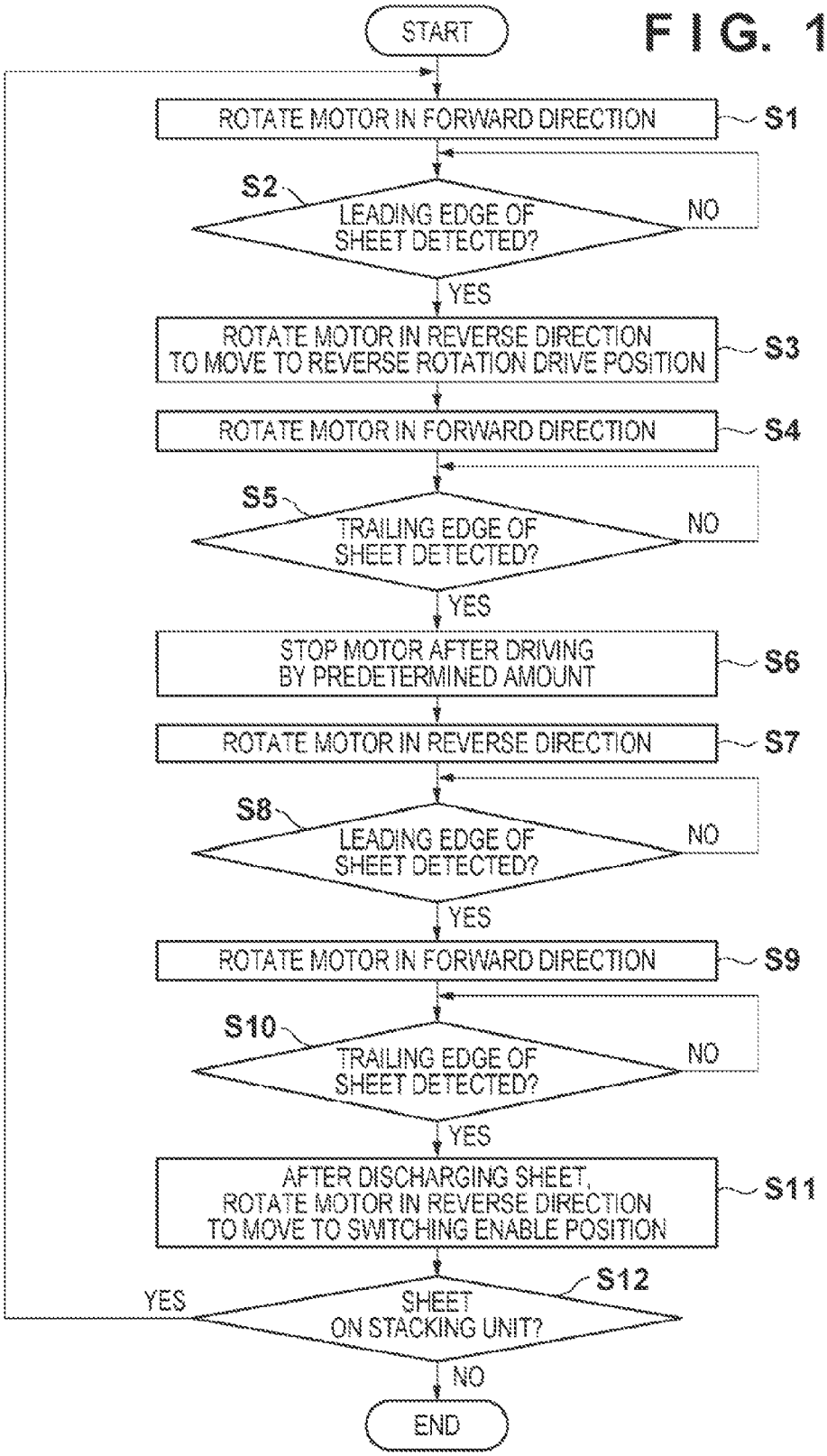
FIG. 12 is a flowchart illustrating an example of processing executed by the control unit.

FIG. 11 is a block diagram of a control unit according to this embodiment. A control unit 301 includes a CPU 310 that performs control, calculation, determination, and the like, a ROM 311 that stores control programs, various kinds of parameters, constants, and the like, and a RAM 312 that stores various kinds of data of image processing and the like. The control unit 301 is connected to a host device 400 such as an external computer via an interface 317. The control unit 301 also includes a motor driver 313 to be used to control the motor 17.

A series of double-sided document reading operations of the automatic feeding and reading apparatus 1 will be described with reference to FIGS. 1 to 12. FIG. 13 shows the control steps and the state of each unit in each step. When a document is stacked on the document feed tray 15, and a reading start instruction is input, the motor 17 rotates in the forward direction (first rotation direction), and the feeding planet gear arm 44 moves to the feeding position to feed the document (step S1).

When the document edge sensor 53 detects the leading edge of the obverse surface of the document (step S2), the motor 17 rotates in the direction (second rotation direction) reverse to the forward direction. By the reverse rotation, the feeding planet gear arm 44 rotates to separate the feeding planet gear 43*a* from the separation roller gear 45*a* and moves to the switching enable position and then to the reverse rotation drive position (step S3). In step S4, the motor 17 returns to the forward rotation, and the feeding planet gear arm 44 pivots clockwise. The feeding planet gear arm 44 stops at the forward rotation drive position at which the lever portion 80*b* of the control lever 80 formed from a wire spring contacts the cam face 44*b* of the feeding planet gear arm 44.

At this time, even when the motor 17 rotates in the forward direction, the feeding planet gear arm 44 does not pivot counterclockwise, and the feeding planet gear 43*a* does not mesh with the separation roller gear 45*a*. At this forward rotation drive position, the drive is not transferred to the chain of drives from the separation roller gear 45*a*, and the separation roller 45*c* and the pickup roller 47*c* are also at rest. Hence, even when the second and subsequent document sheets are stacked on the document feed tray 15, they remain on the document feed tray 15 without being conveyed.

When the document edge sensor 53 detects the leading edge of the first document sheet, the document reading section 5 starts reading image information of the document obverse surface after the document has been conveyed by a predetermined amount from that position. After that, when the document edge sensor 53 detects the trailing edge of the document obverse surface that is being read, the document reading section 5 ends image information reading after the document has been conveyed by a predetermined amount from that position.

When the document edge sensor 53 detects the trailing edge of the document in step S5, and the document is conveyed by a predetermined amount, the motor 17 temporarily stops (step S6). In this embodiment, the predetermined amount means the distance from the document edge sensor 53 to the position immediately before the trailing edge of the document obverse surface leaves the nip between the discharge rollers 33*a* and the discharge idler rollers 33*c*. At this time, the trailing edge of the document passes through the path switching flapper 75 provided in the document discharge path 13. The path switching flapper 75 is facing down due to the weight of its own so as to open the document reversing path 14.

Up to this point of time, the forward rotation drive of the motor 17 is transferred to the discharge cam planet idler gear 36 via the motor gear, the idler gear 19, the idler gear 20, the feeding sun gear 42, the discharge idler gear 31, the discharge roller gear 32, the discharge cam sun gear 34, and the discharge cam planet gear 35*b*. However, since the pinion 36*a* of the discharge cam planet idler gear 36 faces the untoothed portion 38*b* of the discharge cam gear 38, as shown in FIG. 7A, the rotating force is not transferred to the discharge cam gear 38. In this state, the concave portion 38*e* of the cam face 38*c* of the discharge cam gear 38 faces the cam follower 61*c* of the discharge idler roller holder lever 61*a* (lever member). Hence, the biasing force of the spring 62 to the discharge idler roller holder levers 61*a* and 61*b* acts in the direction in which the discharge idler roller holder 33*d* pivots counterclockwise about the shaft portion 33*e* in steps S1 to S6. The discharge idler rollers 33*c* are thus pressed against the discharge rollers 33*a*.

The reverse surface reading operation during double-sided document reading will be described next. When the document is sandwiched at the nip between the discharge rollers 33*a* and the discharge idler rollers 33*c*, and the motor 17 is temporarily at rest, the path switching flapper 75 opens the document reversing path 14, as described above. In step S7, the motor 17 that is temporarily at rest rotates in the reverse direction to perform switchback conveyance to make the trailing edge of the document enter the document reversing path 14. The document reversing path 14 joins the document conveyance path 11 before the conveyance rollers 27*a*. For this reason, when the motor 17 continues rotating in the reverse direction, the document trailing edge at the time of obverse surface reading is guided to the conveyance rollers 27*a* as the new leading edge. Due to the reverse rotation of the motor 17 at this time, the feeding planet gear arm 44 rotates counterclockwise and moves to the switching enable position and then to the reverse rotation drive position. Thus conveying the document to the document reversing path 14 in the reverse direction from its trailing edge allows to direct the reverse surface of the document to the side of the document reading platen glass 51 and cause the document reading section 5 to read the reverse surface of the document.

When the motor 17 is rotatably driven in the reverse direction, the discharge cam sun gear 34 also rotates in the reverse direction. The discharge cam planet gear arm 37 swings, and the discharge cam planet gear 35*b* meshes with the discharge cam gear 38. Since the discharge cam gear 38 includes the gear portion 38*h* at the portion meshed with the discharge cam planet gear 35*a*, as shown in FIG. 7B, the discharge cam gear 38 that has been at rest during the forward rotation of the motor 17 starts rotating as the motor 17 is rotatably driven in the reverse direction. However, since the gear portion 38*h* is formed in correspondence with several teeth, the discharge cam planet gear 35*b* reaches the untoothed portion 38*a* as the discharge cam gear 38 rotates, and the drive to the discharge cam gear 38 stops. That is, when the motor 17 continuously rotatably driven in the reverse direction, the discharge cam gear 38 can be driven in a rotation amount corresponding to the gear portion 38*h* and stopped. At this time, the pinion 36*a* of the discharge cam planet idler gear 36 meshes with the gear portion 38*j* of the discharge cam gear 38, as described above.

Additionally, when the motor 17 is rotatably driven in the reverse direction, the conveyance planet gear arm 24 also swings. The conveyance planet gear 22*b* meshes with the conveyance planet-idler gear 23, and the drive is transferred to the conveyance roller gear 26 and the conveyance rollers 27*a*. Although the motor 17 rotates in the reverse direction, the rotation direction of the conveyance rollers 27*a* is the same as that when the motor 17 rotates in the forward direction because the drive transfer to the conveyance rollers 27*a* is done via the conveyance planet-idler gear 23. The document conveyed through the document reversing path 14 by the discharge rollers 33*a* is sandwiched and conveyed by the conveyance rollers 27*a*. When the document edge sensor 53 detects the leading edge of the document (the trailing edge upon obverse surface reading) (step S8), it is determined that the document has been conveyed through the document reversing path 14 without document jam. At this point of time, the motor 17 returns to the forward rotation (step S9).

When the motor 17 is rotatably driven in the forward direction, the conveyance planet gear arm 24 swings again. The conveyance planet gear 22*a* meshes with the conveyance roller gear 26, and the drive is transferred to the conveyance rollers 27*a*. Hence, the document sandwiched between the conveyance rollers 27*a* and the conveyance idler rollers 27*c* is conveyed toward the document reading path 12. The feeding planet gear arm 44 moves from the reverse rotation drive position to the forward rotation drive position when the motor 17 is rotatably driven in the forward direction. The discharge cam sun gear 34 also rotates in the forward direction, the discharge cam planet gear arm 37 swings, and the discharge cam planet gear 35*a* meshes with the discharge cam planet idler gear 36.

At this time, the discharge cam planet idler gear 36 meshes with the discharge cam gear 38, as described above. Hence, the forward rotation of the motor 17 is transferred to the discharge cam gear 38 to rotatably drive it. When the discharge cam gear 38 is rotatably driven, the cam follower 61*c* engages with the inclined surface 38*f* of the cam face 38*c* to start pushing down the discharge idler roller holder lever 61*a* against the spring force of the spring 62. The discharge rollers 33*a* and the discharge idler rollers 33*c* thus cancel the press-contacted state therebetween and separate from each other (FIG. 7C).

On the other hand, after the rotation direction of the discharge roller gear 32 has changed to separate the protruding portion 32*b* from the protruding portion 30*a* of the discharge roller driving shaft, the rotation is not transferred to the discharge rollers 33*a* until the protruding portion 32*b* contacts the protruding portion 30*a* again. The delaying mechanism acts not to immediately transfer the drive of the forward rotation of the motor 17 to the discharge rollers 33*a*. That is, during non transferring of drive to the discharge rollers 33*a*, the discharge rollers 33*a* separate from the discharge idler rollers 33*c*. Hence, even when the rotation direction of the motor 17 is switched from the reverse direction to the forward direction to rotate the conveyance rollers 27*a* and the discharge rollers 33*a* in opposite directions, the document can be conveyed by the conveyance rollers 27*a* without being pulled from both sides, and the discharge rollers 33*a* can separate from the discharge idler rollers 33*c*.

As in the time of obverse surface reading, the document edge sensor 53 detects the leading edge (the trailing edge of the document obverse surface) of the document reverse surface. The document reading section 5 starts reading image information of the document reverse surface after the document has been conveyed by a predetermined amount from that position.

Note that in this embodiment, to make the device as small as possible, the paper path length corresponding to the sum of the document reversing path 14, the document conveyance path 11, the document reading path 12, and the document discharge path 13 is minimized so as to be shorter than the conveyance-direction length of the document to be conveyed. For this reason, when the leading edge of the document reverse surface reaches the discharge rollers 33*a* during reading of the reverse surface of the double-sided document, the trailing edge of the document reverse surface is still located on the side of the document discharge tray 16 relative to the discharge rollers 33*a*. That is, the near leading edge portion and the near trailing edge portion of a single document, which is passing through the paper path having an almost U shape, pass by each other between the discharge rollers 33*a* and the discharge idler rollers 33*c*. However, since the discharge idler rollers 33*c* separate from the discharge rollers 33*a* at this time, as described above, the leading edge and the trailing edge of the document can pass by without jam upon reading the document reverse surface.

Before the trailing edge of the document reverse surface passes the discharge rollers 33*a* and reaches the conveyance rollers 27*a*, a discharge cam 39*a* rotates by a predetermined amount. The discharge idler rollers 33*c* contact the discharge rollers 33*a* again, and the document is conveyed being sandwiched by the conveyance rollers 27*a* and the discharge rollers 33*a*. After that, the discharge cam gear 38 reaches the untoothed portion 38*b*, as described above, the drive from the motor 17 stops, and the rotation stop, thus restoring the initial state.

After that, when the document edge sensor 53 detects the trailing edge of the document reverse surface that is being read (step S10), the document reading section 5 ends reading image information on the reverse surface after the document has been conveyed by a predetermined amount from that position. The document is then conveyed to the document discharge tray 16. The document is conveyed until it passes the discharge rollers 33*a* after detection of the trailing edge of the document. Then, the motor 17 rotates in the reverse direction (step S11) to move the feeding planet gear arm 44 from the forward rotation drive position to the switching enable position. In step S12, the document presence/absence sensor 54 detects the presence/absence of a document stacked on the document feed tray 15. If a document exists, the process returns to step S1 to start reading the next document. Upon detecting that there is no document stacked on the document feed tray 15 any more, the reading operation ends.

If a plurality of document sheets are directly discharged to the document discharge tray 16, they have a page order different from that on the document feed tray 15 (the obverse and reverse surfaces are turned). The sheets may be arranged in the original page order by conveying them again through the document reversing path 14 without the reading operation after reading the document reverse surface.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefits of Japanese Patent Application No. 2010-293809, filed Dec. 28, 2010, which is hereby incorporated by reference herein in its entirety.

What is claimed is:

1. A reading device comprising:

a first conveyance unit configured to convey a sheet;

a reading unit configured to read an image on the sheet conveyed by the first conveyance unit;

a second conveyance unit configured to convey the sheet in a first direction to receive the sheet from the first conveyance unit and to convey the sheet in a second direction after the conveyance in the first direction to convey the sheet to the first conveyance unit;

a driving source configured to drive the second conveyance unit;

a drive transmitting unit configured to transmit driving force of the driving source to the second conveyance unit, the second conveyance unit conveying the sheet in the first direction when the driving source rotates in a first rotation direction, and the second conveyance unit conveying the sheet in the second direction when the driving source rotates in a second rotation direction; and a control unit configured to perform a change of the rotation direction of the driving source such that the rotation direction of the driving source changes from the second rotation direction to the first rotation direction when the second conveyance unit conveys the sheet in the second direction while the first conveyance unit conveys the same sheet, wherein the second conveyance unit comprises a conveyance roller and a pinch roller configured to pinch the sheet in cooperation with the conveyance roller, and the drive transmitting unit temporarily stops transmitting the driving force to the conveyance roller so that the conveyance roller can freely rotate when the rotation direction of the driving source changes from the second rotation direction to the first rotation direction.

2. The reading device according to claim 1, wherein the drive transmitting unit is configured to transmit driving force of the driving source to the first conveyance unit such that said first conveyance unit conveys the sheet toward the second conveyance unit independently of a rotation direction of the driving source.

3. The reading device according to claim 1, wherein the control unit performs the change of the rotation direction of the driving source before the sheet arrived at the reading unit.

4. The reading device according to claim 1, further comprising a moving unit configured to move the pinch roller to a position apart from the conveyance roller, wherein the drive transmitting unit transmits the driving force to the conveyance roller while the moving unit moves the pinch roller to the position apart from the conveyance roller after the rotation direction of the driving source is changed to the first driving rotation direction.

5. A reading device comprising:

a first conveyance unit configured to convey a sheet;

a reading unit configured to read an image on the sheet conveyed by the first conveyance unit;

a second conveyance unit configured to convey the sheet in a first direction to receive the sheet from the first conveyance unit and to convey the sheet in a second direction after the conveyance in the first direction to convey the sheet to the first conveyance unit;

a driving source configured to drive the second conveyance unit;

a drive transmitting unit configured to transmit driving force of the driving source to the second conveyance unit, the second conveyance unit conveying the sheet in the first direction when the driving source rotates in a first driving rotation direction, and the second conveyance unit conveying the sheet in the second direction when the driving source rotates in a second driving rotation direction; and a control unit configured to perform a change of driving rotation direction of the driving source such that the driving rotation direction of the driving source changes from the second driving rotation direction to the first driving rotation direction when the second conveyance unit conveys the sheet in the second direction while the first conveyance unit conveys the same sheet, wherein the drive transmitting unit temporarily stops transmitting the driving force to the second conveyance unit when the driving rotation direction of the driving source changes from the second driving rotation direction to the first driving rotation direction, and the drive transmitting unit transmits the driving force to the second conveyance unit when a rotation amount of the drive source after a change of the driving rotation direction of the driving source to the first driving rotation direction reaches a predetermined amount.

6. A conveyance device comprising:

a conveyance unit configured to convey a sheet;

a conveyance roller configured to rotate in a first direction so as to receive the sheet from the conveyance unit and to rotate in a second direction opposite to the first direction so as to convey the sheet to the conveyance unit;

a pinch roller configured to pinch the sheet in cooperation with the conveyance roller; and a transmitting unit configured to transmit driving force of a driving source to the conveyance roller so that a rotation direction of the conveyance roller changes between the first direction and the second direction according to a rotation direction of the driving source, wherein the conveyance roller rotates in the first direction when the driving source rotates in a first driving rotation direction, the conveyance roller rotates in the second direction when the driving source rotates in a second driving rotation direction, and the transmitting unit temporarily stops transmitting the driving force to the conveyance roller so that the conveyance roller can freely rotate when the driving rotation direction of the driving source is changed from the second driving rotation direction to the first driving rotation direction.

7. The device according to claim 6, further comprising a moving unit configured to move the pinch roller to a position apart from the conveyance roller, wherein the transmitting unit transmits the driving force to the conveyance roller while the moving unit moves the pinch roller to the position apart from the conveyance roller after the rotation direction of the driving source is changed from the second driving rotation direction to the first driving rotation direction.

8. The device according to claim 7, wherein the moving unit moves the pinch roller to the position apart from the conveyance roller by receiving a transmission of the driving force of the driving source.

9. The device according to claim 6, further comprising a moving unit configured to move the pinch roller to a position apart from the conveyance roller, wherein the transmitting unit transmits the driving force to the conveyance roller while the moving unit moves the pinch roller to the position apart from the conveyance roller and the rotation direction of the conveyance roller is changed from the second direction to the first direction.

10. A conveyance device comprising:

a conveyance unit configured to convey a sheet;

a conveyance roller configured to rotate in a first direction so as to receive the sheet from the conveyance unit and to rotate in a second direction opposite to the first direction so as to convey the sheet to the conveyance unit; and, a transmitting unit configured to transmit driving force of a driving source to the conveyance roller so that a rotation direction of the conveyance roller changes between the first direction and the second direction according to a rotation direction of the driving source, wherein the conveyance roller rotates in the first direction when the driving source rotates in a first driving rotation direction, the conveyance roller rotates in the second direction when the driving source rotates in a second driving rotation direction, the transmitting unit temporarily stops transmitting the driving force to the conveyance roller when the rotation direction of the driving source is changed from the second driving rotation direction to the first driving rotation direction, and the transmitting unit transmits the driving force to the conveyance roller when a rotation amount of the driving source after a change of the rotation direction of the driving source from the second driving rotation direction to the first driving rotation direction reaches a predetermined amount.

11. A reading device comprising:

a reading unit configured to read an image on a sheet;

a conveyance unit configured to convey the sheet in a predetermined direction such that a first side of the sheet is read by the reading unit;

a conveyance roller configured to rotate in a first direction so as to receive the sheet from the conveyance unit and to rotate in a second direction opposite to the first direction so as to convey the sheet to the conveyance unit such that a second side of the sheet is read;

a pinch roller configured to pinch the sheet in cooperation with the conveyance roller; and a transmitting unit configured to transmit driving force of a driving source to the conveyance unit independently of a rotation direction of the driving source and to transmit the driving force of the driving source to the conveyance roller so that a rotation direction of the conveyance roller changes between the first direction and the second direction according to a rotation direction of the driving source, wherein the conveyance roller rotates in the first direction when the driving source rotates in a first driving rotation direction, the conveyance roller rotates in the second direction when the driving source rotates in a second driving rotation direction, and the transmitting unit temporarily stops transmitting the driving force to the conveyance roller so that the conveyance roller can freely rotate when the rotation direction of the driving source is changed from the second driving rotation direction to the first driving rotation direction.

12. The device according to claim 11, further comprising a moving unit configured to move the pinch roller to a position apart from the conveyance roller, wherein the transmitting unit transmits the driving force to the conveyance roller while the moving unit moves the pinch roller to the position apart from the conveyance roller after the rotation direction of the driving source is changed from the second driving rotation direction to the first driving rotation direction.

13. A reading device comprising:

a reading unit configured to read an image on a sheet;

a conveyance unit configured to convey the sheet in a predetermined direction such that the image on the sheet is read by the reading unit;

a conveyance roller configured to rotate in a first direction so as to receive the sheet from the conveyance unit and to rotate in a second direction opposite to the first direction so as to convey the sheet to the conveyance unit such that the image on the sheet is read; and a transmitting unit configured to transmit driving force of a driving source to the conveyance unit independently of a rotation direction of the driving source and to transmit the driving force of the driving source to the conveyance roller so that a rotation direction of the conveyance roller changes between the first direction and the second direction according to a rotation direction of the driving source, wherein the conveyance roller rotates in the first direction when the driving source rotates in a first driving rotation direction, the conveyance roller rotates in the second direction when the driving source rotates in a second driving rotation direction, the transmitting unit temporarily stops transmitting the driving force to the conveyance roller when the rotation direction of the driving source is changed from the second driving rotation direction to the first driving rotation direction, and the transmitting unit transmits the driving force to the conveyance roller when a rotation amount of the driving source after a change of the driving rotation direction from the second driving rotation direction to the first driving rotation direction reaches a predetermined amount.

* * * * *